US011790439B1

(12) United States Patent
Griggs et al.

(10) Patent No.: US 11,790,439 B1
(45) Date of Patent: Oct. 17, 2023

(54) AUTOMATED BIDDING ON AUCTIONED CONTENT

(71) Applicant: El Toro.Com, LLC, Louisville, KY (US)

(72) Inventors: Stacy B. Griggs, Shelbyville, KY (US); David T. Stadler, III, Louisville, KY (US); Richard M. Teachout, III, Louisville, KY (US); Benjamin Charles Woolley, Bothell, WA (US)

(73) Assignee: EL TORO.COM, LLC, Louisville, KY (US)

( * ) Notice: Subject to any disclaimer, the term of this patent is extended or adjusted under 35 U.S.C. 154(b) by 74 days.

(21) Appl. No.: 17/340,359

(22) Filed: Jun. 7, 2021

Related U.S. Application Data

(62) Division of application No. 15/049,532, filed on Feb. 22, 2016, now Pat. No. 11,037,228.

(51) Int. Cl.
*G06Q 30/00* (2023.01)
*G06Q 30/08* (2012.01)

(52) U.S. Cl.
CPC ..... *G06Q 30/08* (2013.01)

(58) Field of Classification Search
CPC ..... G06Q 30/00; G06Q 30/02; G06Q 30/08; G06Q 30/0275
See application file for complete search history.

(56) References Cited

U.S. PATENT DOCUMENTS 4,887,818 A * 12/1989 Escort ..... A63F 3/00088 273/254
7,933,798 B1 * 4/2011 Yan ..... G06Q 40/12 705/14.42
7,996,267 B2 8/2011 Qi et al.
8,046,294 B2 * 10/2011 Zhou ..... G06Q 30/08 705/37
8,277,320 B1 * 10/2012 Hart ..... A63F 13/795 463/42
8,335,717 B2 12/2012 Deng et al.
(Continued)

OTHER PUBLICATIONS

Wang, Jun, Weinan Zhang, and Shuai Yuan. "Display advertising with real-time bidding (RTB) and behavioural targeting." Foundations and Trends® in Information Retrieval 11.4-5 (2017): 297-435. (Year: 2017).*

(Continued)

*Primary Examiner* — Christopher B Seibert
(74) *Attorney, Agent, or Firm* — Gray Ice Higdon

(57) ABSTRACT

Systems, methods, and computer-readable media (transitory and non-transitory) are provided herein for automated bidding on auctioned online content. In various embodiments, a bidder process operating on a bidder management computing system may determine an IP address associated with an impression to be populated with consumable content. The impression may be solicited by a content auction computing system. The bidder process may retrieve, e.g., from volatile memory local to the bidder process management computing system, bidding guidelines associated with the IP address. The bidder process may determine, based on the retrieved bidding guidelines, a bid for a particular consumable content item to populate the solicited impression. The bidder process may then submit the bid to the content auction computing system.

15 Claims, 6 Drawing Sheets

(56) References Cited

U.S. PATENT DOCUMENTS 8,365,241 B1* 1/2013 Gunda ..... H04L 67/02 726/1
2002/0077953 A1* 6/2002 Dutta ..... G06Q 30/08 705/37
2003/0055729 A1* 3/2003 Bezos ..... G06Q 30/08 705/14.66
2004/0267658 A1 12/2004 Sandholm et al.
2006/0293995 A1* 12/2006 Borgs ..... G06F 16/951 705/37
2007/0083611 A1* 4/2007 Farago ..... H04L 67/53 709/217
2007/0113250 A1* 5/2007 Logan ..... H04N 7/17318 348/E7.071
2008/0108371 A1 5/2008 Alizadeh-Shabdiz et al.
2008/0133258 A1* 6/2008 Kontogouris ..... G06Q 10/0875 705/29
2009/0012868 A1* 1/2009 DeAngelis ..... G06Q 40/04 705/37
2009/0129377 A1* 5/2009 Chamberlain ..... H04L 67/306 370/389
2009/0248522 A1* 10/2009 Hu ..... G06Q 30/02 705/26.1
2009/0325685 A1* 12/2009 Webb ..... A63F 13/79 463/25
2010/0324973 A1* 12/2010 D'Ambrosio ..... G06Q 30/02 705/344
2011/0184816 A1 7/2011 Jones
2011/0246298 A1 10/2011 Williams et al.
2011/0288928 A1* 11/2011 Patwa ..... G06Q 30/02 705/14.42
2012/0036000 A1* 2/2012 Mesaros ..... G06Q 30/0267 705/14.25
2012/0036034 A1 2/2012 Golden et al.
2012/0058742 A1* 3/2012 Razoumov ..... H04L 41/5058 455/406
2012/0123928 A1* 5/2012 Baggott ..... G06Q 30/08 705/37
2013/0268351 A1 10/2013 Abraham et al.
2014/0095324 A1 4/2014 Cabral et al.
2014/0222570 A1 8/2014 Devolites
2014/0236725 A1* 8/2014 Golden ..... G06Q 30/0261 705/14.58
2014/0372202 A1 12/2014 Hummel et al.
2015/0058088 A1 2/2015 Unser et al.
2015/0058138 A1 2/2015 Schler
2015/0154650 A1 6/2015 Umeda
2015/0310502 A1 10/2015 Tang et al.
2016/0117726 A1 4/2016 Lee
2016/0117736 A1 4/2016 Dasdan et al.
2017/0161793 A1* 6/2017 Knapp ..... G06Q 30/0255

OTHER PUBLICATIONS

Aly, Mazen. "Automated Bid Adjustments in Search Engine Advertising." (2017). (Year: 2017).*
Antoniou, Dimitris, et al. "Exposing click-fraud using a bursy detection algorithm." 2011 IEEE Symposium on Computers and Communications (ISCC). IEEE, 2011. 2011.
Vaughan-Nichols, Steven J., Will Mobile Computing's Future be Location, Location, Location?, Industry Trends, IEEE 2009, all pages. 2009.
Bojinov et al., Mobile Device Identification via Sensor Fingerprinting, arxiv.org, Aug. 6, 2014.
Ockenfels, Axel, and Alvin E. Roth. "Late and multiple bidding in second price internet auctions: Theory and evidence concerning different rules for ending an auction." Games and Economic behavior 55.2 (2006): 297-320. (year: 2006).
Authors (anonymously) et al., Advertising Bidding System and Method, printed from www.ip.com (https://priorart.ip.com/IPCOM/000138556, Jul. 24, 2006.

* cited by examiner

300

400

AUTOMATED BIDDING ON AUCTIONED CONTENT

BACKGROUND

Real time bidding is the process by which online content providers "bid" for the right to populate so-called "impressions" with additional online content such as promotional materials. An "impression" may refer to an opportunity, facilitated by a publisher of online content, for a third party to make content available to a user for consumption. A commonly-known example of an impression is a spatial portion of a website, such as a banner portion, that may be selectively populated with content such as a graphical banner. Another example of an impression is a time interval inserted between songs or videos of an online media streaming service. Various entities may "bid" for the right to populate impressions with their content. For example, entities may deploy (e.g., on a "demand side platform," or "DSP") so-called "bidder processes" that automatically, without routine human intervention, bid for impressions solicited by publishers, in a process that is often referred to a "programmatic buying." In a typical scenario, a bidder process learns of an available impression, e.g., from an auction node, when a user conducts activity such as loading a webpage that includes one or more impressions.

When notified of an available impression, many bidder processes may obtain one or more so-called "cookies" (small pieces of data that provide information about a user's online behavior) associated with the user for which the impression is available. The bidder processes may then perform various types of analysis using the cookie in order to determine an appropriate bid to populate the impression with online content. Suppose the cookie indicates the user has recently visited multiple websites relating to outdoor activities. A bidder process with outdoor-related online content in its inventory may make a relatively high bid for that impression because there is a relatively high likelihood the user will be interested in the online content. A bidder process with only irrelevant content in its inventory may not make a bid for the impression at all, or may make a relatively low bid.

Calculating bids based on cookies may have various shortcomings. For example, cookies may be spoofed or copied in order to cause entities to overspend on impressions that are not likely to be effective. Moreover, cookies are ephemeral in nature, and therefore may not be the best indicators for long term behavior of a user. Additionally, analyzing cookies and calculating bids based on the analysis may be relatively complex, and in some cases may require communication between multiple computing systems over one or more networks. It may be relatively difficult to update bidder process databases to properly reflect winning bids, click through rates, and so forth, when records are indexed by something as that changes and/or expires as frequently as a cookie. And an online auction may be won in a matter of microseconds. Thus, the inherent latency associated with cookie analysis and calculation may put the bidder process at a competitive disadvantage.

SUMMARY

This specification is directed generally to techniques for automatic calculation and submission of bids to populate impressions solicited by online publishers with consumable campaign content. When a user operates a computing device to navigate a software application to an online interface provided by a publisher, the online interface may include one or more impressions. The publisher may solicit the one or more impressions to a content auction service such as a demand side platform ("DSP"). The content auction service may initiate an auction to solicit bids to populate the one or more impressions with campaign content. Bidder processes may have seats at the auction, and may calculate and submit bids for the impressions automatically, within a duration of the auction. To obtain a competitive advantage over traditional bidder processes, bidder process configured with selected aspects of the present disclosure may be provided with so-called "bidding guidelines" that the bidder processes can use to quickly determine and submit bids to populate the one or more impressions with campaign content. The bidding guidelines may be determined using network identifiers such as IP addresses, in addition to or instead of cookies. Additionally, in some embodiments, the bidding guidelines may include so-called "demand slope" data and/or pre-calculated bids, which a bidder process may obtain and quickly process and/or submit, avoiding lengthy calculations on the fly.

In some embodiments, a method may include the following operations: determining, by a bidder process operating on a bidder management computing system, an IP address associated with an impression to be populated with consumable content, wherein the impression is solicited by a content auction computing system; retrieving, by the bidder process, from volatile memory local to the bidder process management computing system, bidding guidelines associated with the IP address; determining, by the bidder process, based on the retrieved bidding guidelines, a bid for a particular consumable content item to populate the solicited impression; and submitting, by the bidder process, the bid to the content auction computing system.

This method and other implementations of technology disclosed herein may each optionally include one or more of the following features.

In some embodiments, the content auction computing system may be a demand-side platform ("DSP") system. In some embodiments, the bidding guidelines include statistics pertaining to historical content consumption at the IP address. In some embodiments, the bidding guidelines include an identifier associated with the particular consumable content item. In some embodiments, the bidding guidelines include statistics pertaining to consumption of the consumable content item at the IP address.

In some embodiments, the solicited impression may include a region of a webpage, and the consumable content item comprises a media file that is capable of being rendered in the region. In some embodiments, the solicited impression may include a time interval inserted between renditions of audio or visual media content at an end user device, and the consumable content item comprises an audio or visual media file that is capable of being played within the time interval.

In some embodiments, the bidding guidelines may include pre-calculated data useable by the bidder process to determine the bid. In some embodiments, the pre-calculated data may include a pre-calculated bid to populate the solicited impression with the consumable content item. In some embodiments, the method may further include calculating the pre-calculated bid based at least in part on a comparison of a target winning pace to an actual winning pace.

In some embodiments, the retrieving may include: mapping a matching IP address in an index stored in non-volatile memory allocated to the bidder process to a memory location within a memory-mapped region of volatile memory writable by the bidder management computing system and available to the bidder process; and retrieving the data associated with the IP address from the memory location.

In some embodiments, the method may further include: appending, to the memory-mapped region, data indicative of an outcome of submitting the bid; and updating the index available to the bidder process to map the IP address to the appended data.

Other implementations may include one or more non-transitory computer readable storage media storing instructions executable by a processor to perform a method such as one or more of the methods described above. Yet another implementation may include a system including memory and one or more processors operable to execute instructions, stored in the memory, to perform a method such as one or more of the methods described above.

It should be appreciated that all combinations of the foregoing concepts and additional concepts described in greater detail herein are contemplated as being part of the subject matter disclosed herein. For example, all combinations of claimed subject matter appearing at the end of this disclosure are contemplated as being part of the subject matter disclosed herein.

DETAILED DESCRIPTION

Figure 1:
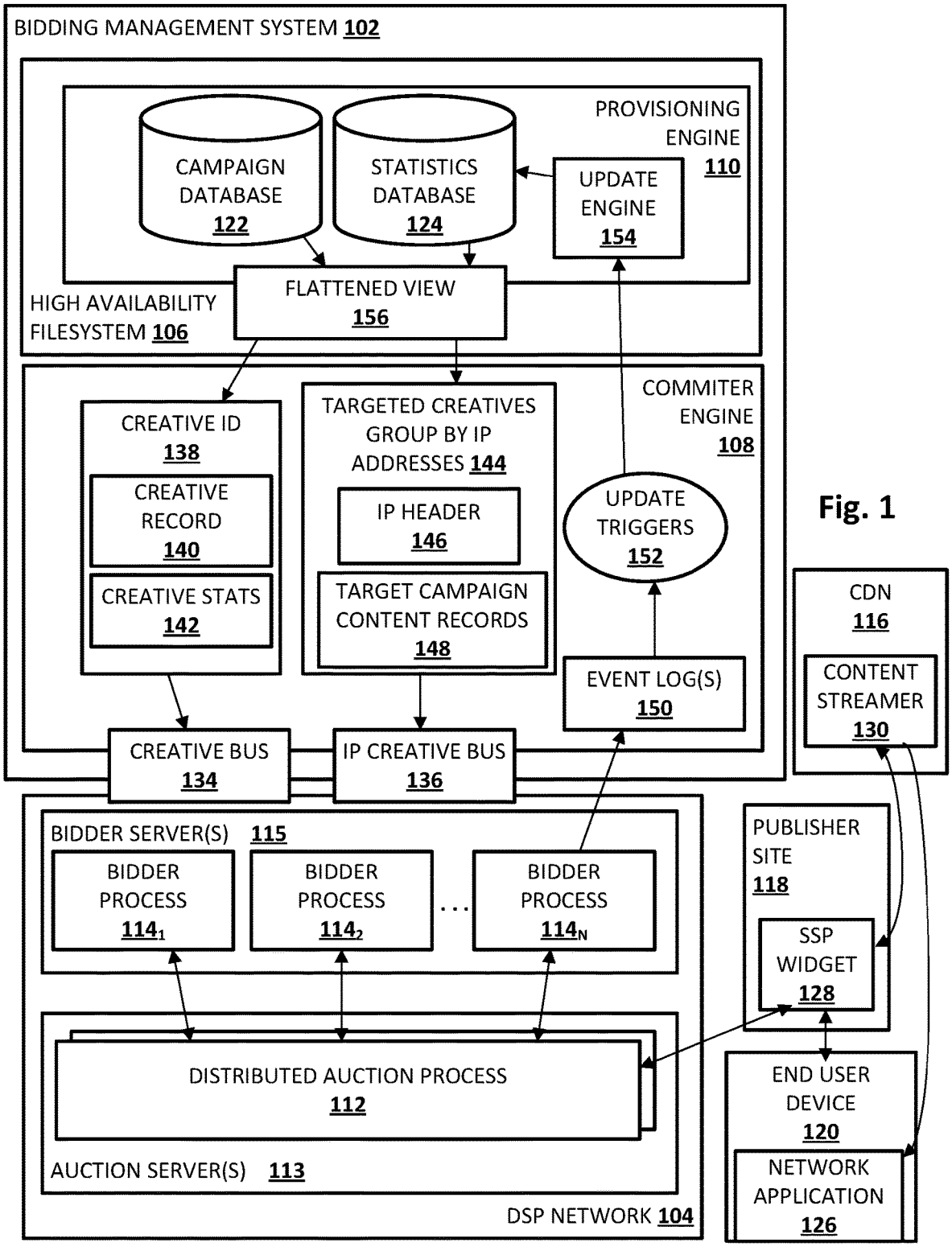
FIG. 1 illustrates an example environment in which bids for auctioned online content may be calculated and submitted, in accordance with various implementations.

FIG. 1 illustrates an example environment in which bids for auctioned online content may be calculated and submitted, in accordance with various implementations. The example environment of FIG. 1 includes a bidding management system 102 and a content auction computing system in the form of a demand side platform ("DSP") network 104. Each of bidding management system 102 and DSP network 104 may include one or computing systems connected by one or more network connections. An example of such a computing system is depicted schematically in FIG. 6. Bidding management system 102 and DSP network 104 also may be in communication with each other via one or more networks (not depicted), such as the Internet.

Various modules or engines may be implemented as part of bidding management system 102 as software, hardware, or any combination of the two. For example, in FIG. 1, bidding management system 102 includes a high availability ("HA") filesystem 106 and a so-called "committer" engine 108. Operating as part of or in conjunction with HA filesystem 106 is a provisioning engine 110. Also depicted in FIG. 1 is a content delivery network ("CDN") 116, a publisher site 118, and an end user device 120, which will be described in more detail below.

DSP network 104 may include one or more distributed auction processes 112 that operate on one or more auction servers 113. One or more auction servers 113 may be operated by the entity that hosts auctions, or they may be rented and/or leased from a third party server farm and employed to operate distributed auction processes 112. One or more bidder servers 115 are also depicted that operate one or more bidder processes $\mathbf{114}_{1\text{-}N}$ for each distributed auction process 112. In FIG. 1, the bidder servers 115 are depicted as part of DSP network 104. However, this is not meant to be limiting, and there is no requirement that bidder servers 115 be part of DSP network 104. In fact, in many circumstances, especially where the auction entity operates its own servers, it may not permit outside parties such as those that might operate bidder processes 114 to install hardware within DSP network 104. However, it may be beneficial nonetheless to minimize network hops between bidder processes 114 and distributed auction processes 112. Accordingly, in various embodiments in which bidder servers 115 are not directly part of DSP network 104, bidder servers 115 may be installed as close as possible to DSP network, e.g., on a server farm geographically proximate to another server farm that hosts distributed auction processes 112, or even on the same third party server farm.

Figure 6:
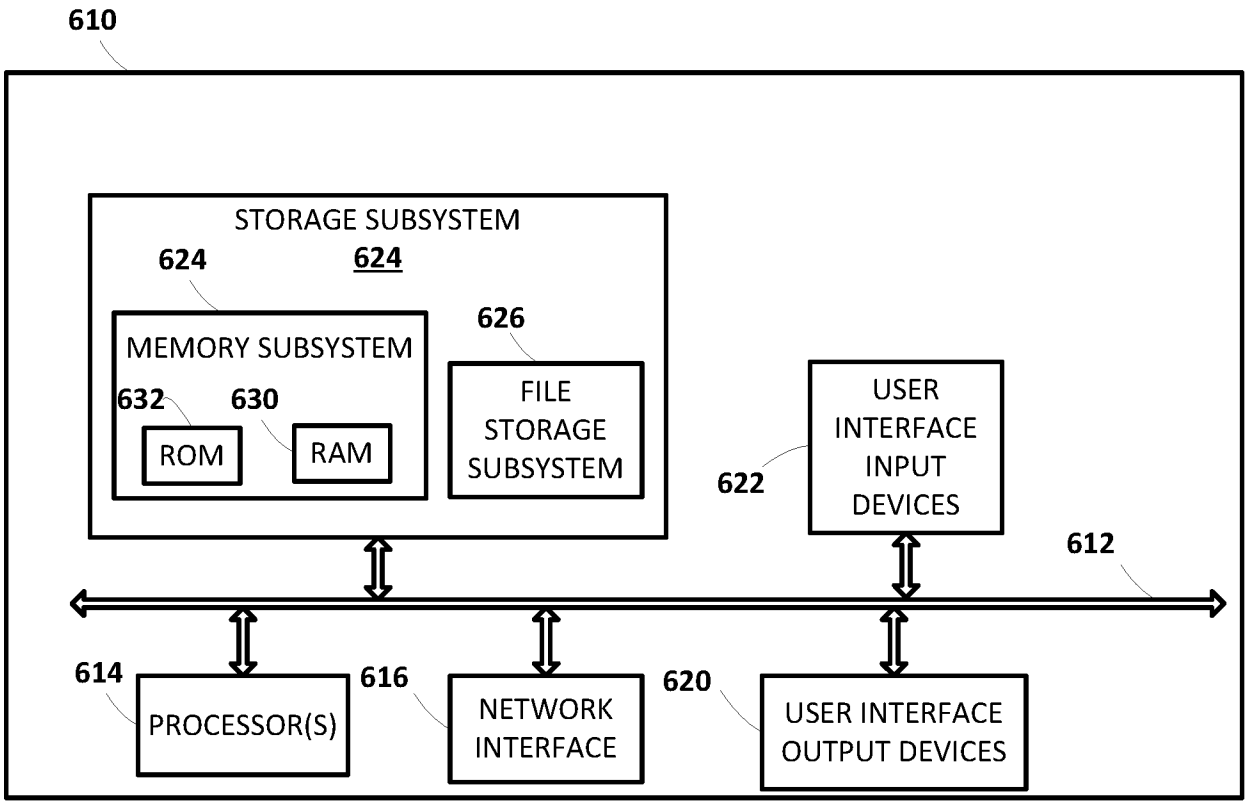
FIG. 6 illustrates an example architecture of a computer system.

The hardware components of the example environment of FIG. 1 may each include memory for storage of data and software applications, a processor for accessing data and executing applications, and components that facilitate communication over a network. In some implementations, such components may include hardware that shares one or more characteristics with the example computer system that is illustrated in FIG. 6. The operations performed by one or more components of the example environment may optionally be distributed across multiple computer systems. End user device 120 may be a computing device that can have various form factors, such as a desktop computer, laptop computer, set top box, mobile phone (a.k.a. "smart" phone), tablet computing device, a gaming console, a plug-in streaming device, a so-called "wearable" computing device such as a smart watch or smart glasses, and so forth.

Generally, bidding management system 102, e.g., by way of provisioning engine 110, receives, organizes, maintains, and/or makes available so-called "campaign information" in one or more databases, such as a in a campaign database 122 and/or a statistics database 124. A "campaign" as used herein may refer to a deliberate and/or organized effort by an entity such as a business or political organization to announce, promote, endorse, solicit, advocate, oppose, denigrate, or otherwise distribute information pertaining to particular subject matter, such as a product, service, viewpoint, political position, etc.

In various embodiments, campaign database 122 may store campaign information pertaining to a campaign initiated, requested, or otherwise instigated by an entity such as a business or political organization. Campaign information may include but is not limited to campaign content "inventory," information about the campaigning entity, information about targeted users, campaign duration, so-called "bid paces" and "win paces" (explained in more detail below), desired wins, impression limits, spending limits, and so forth. Campaign content "inventory" may include "consumable content items" that convey announcements, promotions, endorsements, solicitations, or other positive or negative messages.

"Consumable content items" may refer to various forms of media files that may be "consumed" (e.g., viewed, listened to, watched, or otherwise observed) by an end user. Consumable content items may include but are not limited to graphics (e.g., JPG, GIF, PNG, animations, etc.), audio content (e.g., MP3, WAV, etc.), textual content (e.g., pop ups that only display text, tickers that move across a screen, etc.), and so forth. Campaign content inventory stored in campaign database 122 may include copies of the actual media files, and/or may include identifiers that are usable to locate and/or download the media files, including but not limited to uniform resource identifiers ("URI") and/or uniform resource locators ("URL").

In some implementations, campaign database 122 may additionally or alternatively store network identifiers such as Internet protocol ("IP") addresses associated with a desired target audience. For example, an entity that initiates a campaign may provide a list of IP addresses (or patterns such as regular expressions that match IP addresses having desired characteristics) that the entity wishes to target and/or wishes not to target. In some embodiments, a list of IP addresses provided by a campaigning entity may be IP addresses known to be associated with a particular geographic region, with one or more selected demographics, and so forth, although this is not required.

Statistics database 124 may store historical and/or statistical information associated with campaigning entities, campaign content, and/or targeted users. For example, a variety of key performance indicators may be stored in statistics database 124, including but not limited to click through rates ("CTR"), effective cost per click ("eCPC"), effective cost per action ("eCPA"), and so forth. Other information that may be stored in statistics database 124 includes but is not limited to statistics about a targeted IP address (e.g., how often do devices with that IP address engage with campaign content, what type of campaign content do devices with that IP address engage with the most, etc.), last win times of particular campaign content items, data about winning and losing bids (associated with campaigning entities, consumable content, and/or targeted IP addresses), and so forth.

In this specification, the term "database" will be used broadly to refer to any electronic collection of data. The data of the database does not need to be structured in any particular way, or structured at all, and it can be stored on storage devices in one or more locations. Thus, for example, campaign database 122 and/or statistics database 124 may include multiple collections of data, each of which may be organized and accessed differently. Also, in this specification, the term "record" will be used broadly to refer to any mapping of a plurality of associated information items. A single record need not be present in a single storage device and may include pointers or other indications of information items that may be present in unique segments of a storage device and/or on other storage devices.

In various embodiments, bidding management system 102 may facilitate participation by one or more bidder processes 114 in an auction hosted by a distributed auction process 112 of DSP network 104 as follows. An end user (not depicted) operating end user device 120 may navigate a network application 126 such as a web browser, media consumption application (e.g., streaming audio or video application), or online shopping platform to a particular online interface associated with a particular URI or URL that is hosted by publisher site 118. The online interface may include and/or be associated with one or more impressions.

Online interfaces will be described herein primarily as webpages rendered by web browsers. However, this is not meant to be limiting. Applications may have online interfaces in any number of forms. For example, an online shopping application may present an online interface that is populated, for instance, with information about products and/or services for sale/hire. An impression associated with such an interface may include a banner, a pop-up window, a space to display a video, a space to display content in its native format, or various regions of the interface that may be populated with campaign content. As another example, an impression associated with an audio or video streaming application may include a time interval between songs or videos in which multimedia content such as audio and/or visual campaign content may be presented, as well as a native files, pop up windows, or banners. Even gaming applications may include impressions such as pop ups or intermittent video presentations that may be populated with campaign content. Some gaming applications may even include rendered virtual environments (two dimensional or three dimensional) with "virtual" impressions, such as billboards, sides of buses, etc., that are rendered as part of the virtual environment, and that may be auctioned for population with campaign content using techniques disclosed herein.

Publisher site 118 may direct network application 126 to load a process, or "widget," such as a so-called "supply side platform" ("SSP") widget 128, that may be associated with the online interface. SSP widget 128 may provide information about one or more impressions available through the online interface to DSP network 104. DSP network 104 may deploy an existing and/or initiate a new distributed auction process 112 to auction the impressions. In some embodiments, SSP widget 128 may also supply information about end user device 120 and/or the undepicted end user operating it to DSP network 104. For example, in some embodiments, SSP widget 128 may provide one or more cookies associated with end user device 120 and/or network application 126 to DSP network 104. Additionally or alternatively, SSP widget 128 may supply DSP network 104 with one or more network identifiers associated with end user device 120, such as its IP address, as well as information about the impression, such as its location on a webpage, duration, prominence, etc.

The distributed auction process 112 initiated for or charged with auctioning the impression may solicit bids from one or more bidder processes 114 that have a "seat" at the distributed auction process 112. In some instances, the bidder processes 114 may obtain various information about end user device 120 and/or the end user operating it, e.g., from DSP network 104, SSP widget 128, or using other means. With this information, each bidder process 114 may automatically calculate a bid to populate the one or more impressions with campaign content.

Some bidder processes 114 may be configured to calculate and submit bids with the assistance of bidding management system 102. As will be described in more detail below, bidding management system 102 may facilitate expedited automated bidding for those bidder processes 114, e.g., based at least in part on information other than cookies associated with network application 126 and/or end user device 120. In various embodiments, this expedited automated bidding may give those bidder processes 114 a competitive advantage over other bidder processes 114 that calculate and submit bids using traditional techniques, such as calculations based exclusively or predominantly on cookies associated with network application 126 and/or end user device 120.

In various embodiments, distributed auction process 112 may accept bids for a limited time interval (e.g., on the order of microseconds or milliseconds, such as sixty-microsecond promotional auctions), in which case the highest bid at the end of the time interval may win the opportunity to populate the impression with selected campaign content. In some embodiments, distributed auction process 112 may award the impression to the first bidder process 114 that submits a bid that meets or exceeds a predetermined automatic win price. In yet other embodiments, each seat at distributed auction process 112 may be permitted only a limited number of bids, such as a single bid. In such case, once all seats have submitted a bid (or affirmatively declined to do so), distributed auction process 112 may award the impression to the highest bidder. Although in examples described herein, it is typically the "highest" bidder process 114 that is awarded the impression, this is not meant to be limiting. Bidder processes 114 may be awarded impressions based on other criteria, depending on the circumstances, such as the lowest bidder, or the bidder that satisfies one or more criteria in addition to a highest bid.

Once the winning bidder process 114 is determined, that bidder process 114 may be awarded an impression associated with the online interface hosted by publisher site 118. The winning bidder process 114 may submit information pertaining to the campaign content it bid to populate with impression with, such as a URI or URL, to distributed auction process 112. Distributed auction process 112 may in turn provide this information to SSP widget 128. SSP widget 128 may communicate with CDN network 116, which may host the campaign content, and a content streamer 130 associated with CDN network 116 may provide the campaign content to end user device 120. End user device 120 may then populate the impression with the campaign content downloaded from content streamer 130. For example, if the impression is a spatial portion of a webpage (e.g., on the left or on the right margin) and the campaign content is an animated image, then end user device 120 may render the animated image in the spatial portion of the webpage. Should the end user interact with the campaign content, SSP widget 128 may notify various components of DSP network 104 and/or bidding management system 102 of a successful "click through."

As noted above, some bidder processes 114 configured with selected aspects of the present disclosure may calculate and/or submit bids with the aid of bidding management system 102. In some embodiments, when distributed auction process 112 solicits bids from such bidder processes 114, those bidder processes 114 may interact with and/or receive pre-calculated data (e.g., demand slope data and/or pre-calculated bids) from committer engine 108. Using such pre-calculated data, those bidder processes 114 may be able to determine and submit bids faster than other bidder processes 114 that are not configured with selected aspects of the present disclosure.

For example, committer engine 108 may provide bidder processes 114 with access to a so-called "creative" bus 134 and a so-called "IP creative" bus 136. The creative bus may include information about one or more campaign content items available in inventory of the bidder process 114. For example, through creative bus 134, a bidder process 114 may have access to one or more records 138 indexed by, for instance, a "creative ID." Each record 138 may include a creative record 140 (e.g., URI/URL associated with the consumable campaign content) and creative statistics 142 associated with the creative ID. These statistics may include but are not limited to CTR, eCPC, eCPA, and so forth.

IP creative bus 136 may provide a bidder process 114 access to information about one or more targeted users. For example, through targeted user bus 136, a bidder process 114 may have access to a list 144 of consumable campaign content grouped by IP addresses. Each IP address record 146 may be associated with one or more targeted consumable campaign content records 148. In some embodiments, targeted IP address record 146 may contain sufficient information, such as pre-calculated data (e.g., demand slope data), for a bidder process 114 to quickly calculate a bid on an impression associated with a particular IP address. In other embodiments, one or more of creative bus 134 and/or IP creative bus 136 may provide bidder process 114 with fully pre-calculated bids. For example, bids to populate impressions associated with IP addresses provided by a campaigning entity may be pre-calculated, e.g., by committer engine 108. As the campaign progresses, the bids may be re-calculated, e.g., by committer engine 108, to account for bids won and lost, remaining desired wins, budget, spending limits, etc.

In some embodiments, when a bidder process 114 submits a bid for an impression, it may provide information about the bid it submitted to committer engine 108. Committer engine 108 may then update (or cause to be updated) one or more records in campaign database 122 and/or statistics database 124 to reflect that the bid was submitted. In some embodiments, if the bid is a winning (or losing) bid, one or more records in campaign database 122 and/or statistics database 124 may be updated further. For example, CDN 116, either directly or through SSP widget 128, may send to the winning bidder process 114 the winning second-price bid amount, and/or or a "win ratio," which is a ratio of the second-price bid amount to the winning bid amount. The bidder process 114 may then update one or more event logs 150 associated with committer engine 108 with the winning bid. This may cause one or more update triggers 152 associated with committer engine 108 to cause one or more records in campaign database 122 and/or statistics database 124 to be updated. For example, update triggers 152 may cause an update engine 154 associated with provisioning engine 110 to make the database updates. In some embodiments, committer engine 108, e.g., by way of update triggers 152, may serialize updates provided to update engine 154. By serializing the data, it may be possible to perform database updates without implementing locks, avoiding lock contention.

If a bidder process 114 were required to access one or more records in campaign database 122 and/or statistics database 124 every time it was to submit a bid for an impression, the bidder process 114 may be put at a competitive disadvantage. The time required to access the database records, particularly if multiple databases and/or tables have to be accessed, as well as the time required to calculate the bid based on the retrieved data, may be too great for bidder process 114 to be competitive. Accordingly, in some embodiments, a flattened view 156 of various selected data in campaign database 122 and/or statistics database 124 may be created, e.g., periodically and/or in response to a database update performed by, e.g., update engine 154. Flattened view 156 may be made available to committer engine 108. In some embodiments, committer engine 108 may utilize flattened view 156 to populate and/or update the various records that comprise creative bus 134 and/or IP creative bus 136. In other embodiments, each update may increment counters directly, to avoid the need to count aggregates on each update. Accordingly, the result may be a logical view of totals of a log of events, but physically may be a table of statistical counters that are updated directly.

Figure 2:
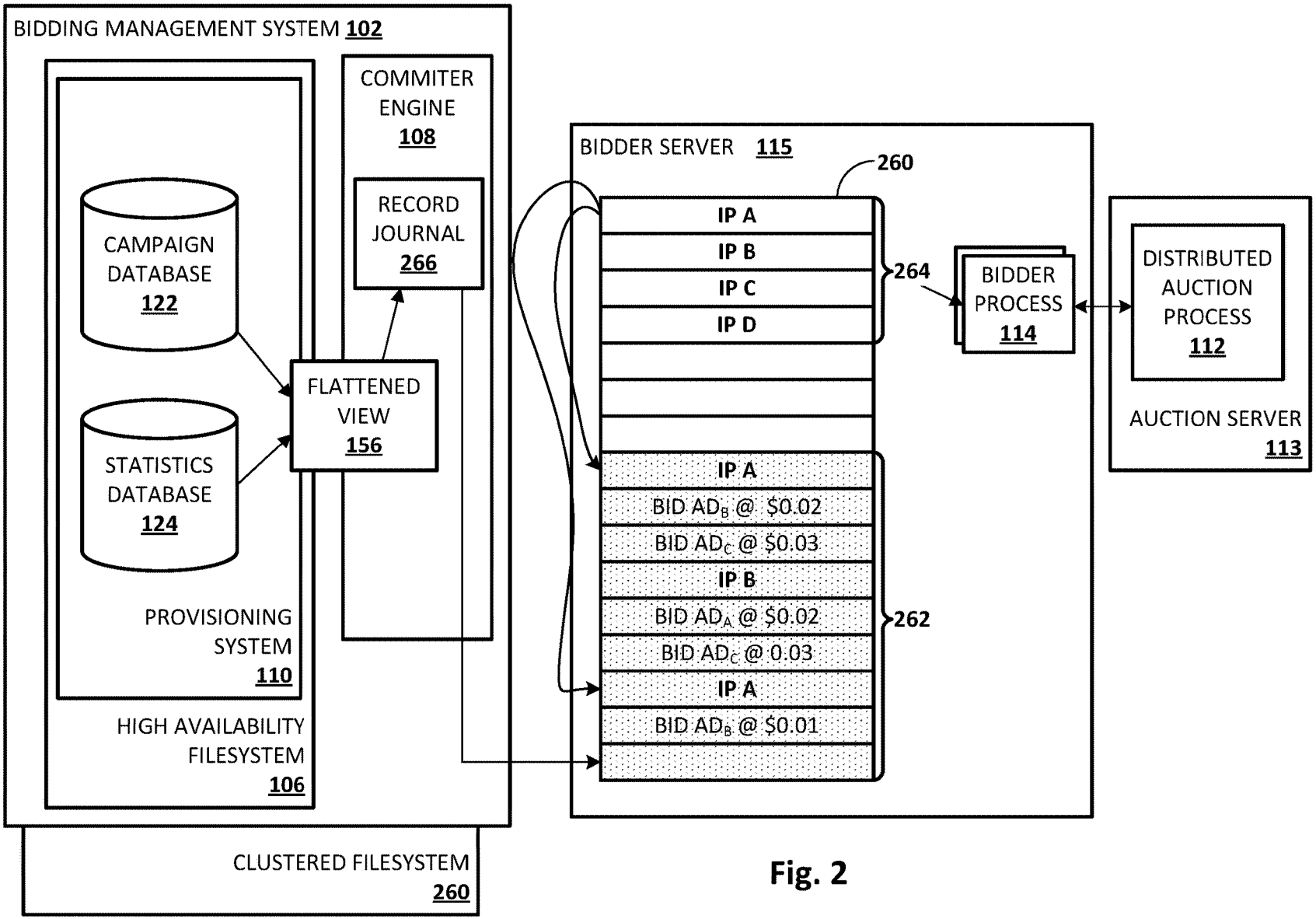
FIG. 2 illustrates in more detail than FIG. 1 certain aspects of the environment, in accordance with various embodiments.

FIG. 2 schematically depicts one example of how pre-calculated data such as demand slope data and/or pre-calculated bids may be made available by bidding management system 102 to bidder processes 114, in accordance with various embodiments. Many of the components are the same as those depicted in FIG. 1, and thus are numbered the same. In some embodiments, a clustered filesystem 260 may be available to (e.g., mounted for) bidding management system 102, e.g., so databases 122/124 and/or data pre-calculated and made available as part of creative bus 134 and/or IP creative bus 136 may be "cloned" at multiple sites, e.g., across the country or around the world. However, clustered filesystem 260 is not required. A single bidder server 115 is depicted in FIG. 2 operating a plurality of bidder processes 114. The bidder processes 114 have seats at an auction hosted by a single distributed auction process 112 operating on auction server 113.

In various embodiments, volatile memory 260 of bidder server 115, which may come in various forms, such as RAM, DRAM, and so forth, may include a memory-mapped region 262 that may represent one possible physical manifestation of the creative bus 134 and/or IP creative bus 136 depicted in FIG. 1. Memory-mapped region 262 may be used to store what will be referred to herein as "bidding guidelines." "Bidding guidelines" may include pre-calculated data such as demand slope data and/or pre-calculated bids, as well as historical/statistical data associated with the IP address, a campaigning entity, and so forth. In some embodiments, memory-mapped region 262 may be designed to be "append only," which means that rather than updating existing records, new records that modify existing records are appended to one end of memory-mapped region 262 (e.g., the bottom of region 262 in FIG. 2, as indicated by the arrow from record journal 266).

Appending records to a database may be faster than updating existing records, which may require re-indexing of the database, a potentially time-consuming process. In addition, using append only databases in combination with relatively long-term index keys such as IP addresses, as opposed to relatively ephemeral index keys such as cookies, may alleviate pressure on bidder server 115 to perform memory allocation. Memory allocations may either be avoided entirely or slab-allocated with real-time constraints.

In some embodiments, memory-mapped region 262 may be indexed by IP addresses. Long-term index keys such as IP addresses may allow for high-overhead indexing strategies that have real-time properties. For example, a bloom filter may be employed to cull potential campaign targets by IP address. A bloom filter may not be as suitable for use with the type of randomized index keys that are typically associated with cookies.

In various embodiments, bidder processes 114 configured with selected aspects of the present disclosure may have a portion of volatile memory 260 allocated to them, e.g., by bidder server 115, for storing an index 264. Index 264 may be populated with targeted IP addresses that map to various locations within memory-mapped region 262. One example of this is demonstrated in FIG. 2 by the two arrows from the memory location within index 264 that stores "IP A" to corresponding memory locations in memory-mapped region 262 that store bidding guidelines for "IP A" (which in this particular example are pre-calculated bids). As noted above, new records are appended to the end of memory-mapped region 262. Accordingly, index 264 associated with each bidder process 114 may be re-indexed so that an IP address points to newly appended records in addition to or instead of previously existing records. Additionally or alternatively, index 264 of each bidder process 114 may be re-indexed on demand and/or pursuant to a predetermined schedule (e.g., at scheduled intervals).

As noted above, the memory location within index 264 that stores "IP A" maps (e.g., using a pointer or other similar means) to one or more memory locations within memory-mapped region 262 that store bidding guidelines for "IP A." These bidding guidelines may include pre-calculated data such as demand slope data and/or pre-calculated bids that are calculated, for example, by various components of bidding management system 102, such as committer engine 108. In the example of FIG. 2, "IP A" is initially mapped to two locations of memory-mapped region 262 that store instructions for bidder process 114 to bid to populate an impression associated with "IP A" with campaign inventory available to bidder process 114, namely, promotion B ("$AD_B$") and promotion C ("$AD_C$"). Promotion B has been deemed worthy of a two-cent bid, and promotion C has been deemed worthy of a three-cent bid.

Sometime later, however, another record was appended to memory-mapped region 262 that alters the bid for promotion B. As shown by the second arrow from the memory location of index 264 that stores "IP A" to memory-mapped region 262, "IP A" is also linked to an instruction to bid to populate an impression associated with "IP A" with promotion B for one cent. This may reflect a variety of circumstantial changes, such a general decrease in demand for impressions associated with "IP A," accumulation of data that demonstrates waning interest at "IP A" in subject matter associated with promotion B, depletion of campaign funds, poor performance of promotion B, and so forth. Of course, bids to populate an impression associated with a particular IP address could just as easily increase, e.g., due to increased demand for that IP address, accumulation of data evidencing interest at that IP address in particular subject matter, surplus campaign funds (especially near the end of a campaign), and so forth.

In some embodiments, memory-mapped region 262 may store historical and/or statistical records, in addition to or instead of pre-calculated bids. Bidder processes 114 may use this data to calculate bids for solicited impressions, rather than simply retrieving and submitting pre-calculated bids. Historical and/or statistical records may include but is not limited to demand slope data (discussed below), CTR, and other statistics about the campaign content, as well as historical data and/or statistics pertaining to the IP address for which the impression is being populated. For example, suppose an end user device (e.g., 120 in FIG. 1) using a particular IP address in the past was operated to select (e.g., click) particular campaign content. This may be evidenced in historical and/or statistical records stored in memory-mapped region 262, and suggests that one or more users behind the IP address may be interested in subject matter to which the particular campaign content pertained. When solicited to bid for an impression associated with the same IP address again, bidder process 114 may be more likely to calculate a relatively high bid for the impression if bidder process 114 has campaign content in its inventory that pertains to the same or similar subject matter.

Figure 3:
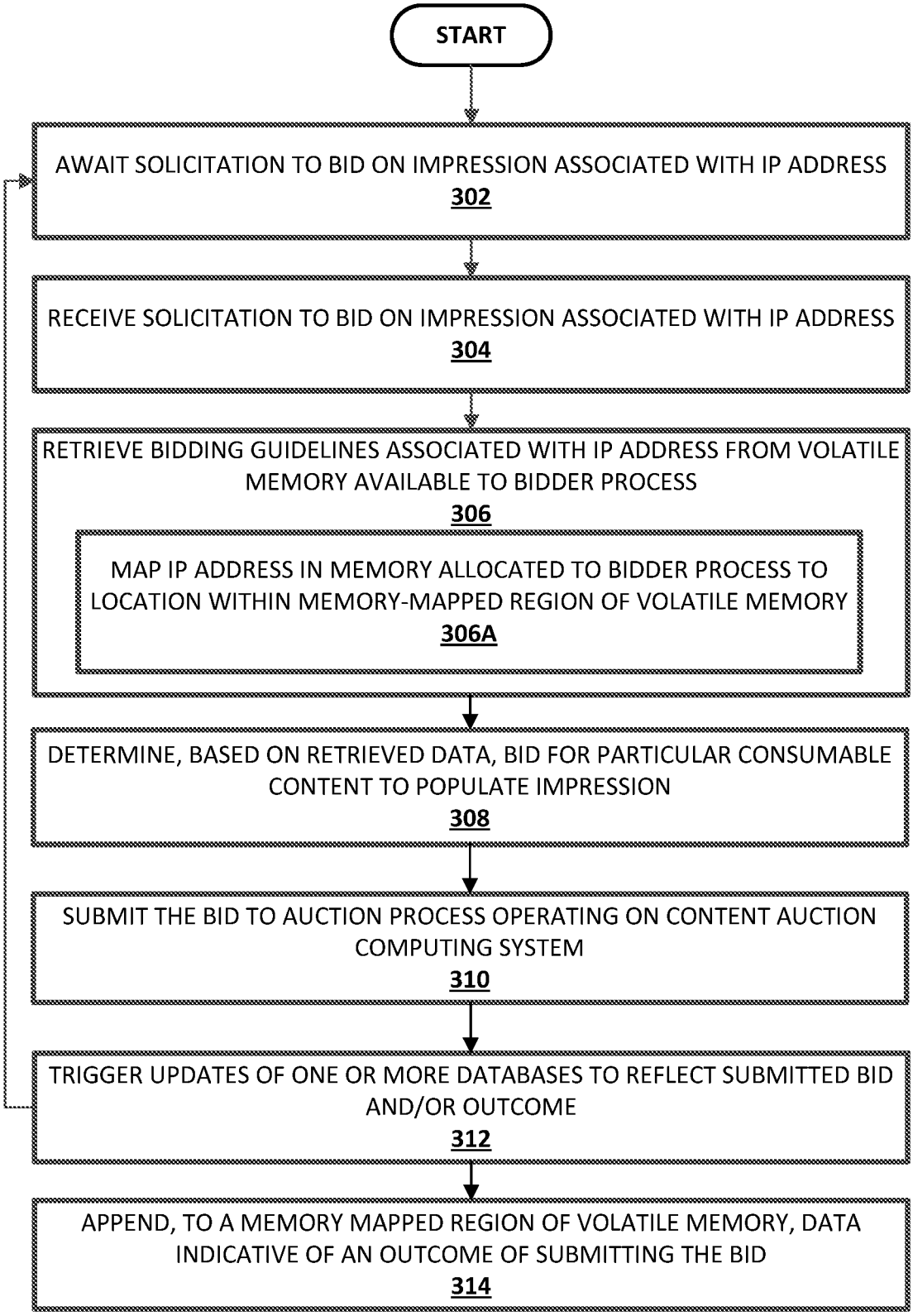
FIG. 3 is a flow chart of an example method for determining and submitting, as part of an online auction, a bid to populate an impression associated with a network identifier with consumable campaign content, in accordance with various embodiments.

FIG. 3 is a flow chart of an example method for automatically bidding for auctioned impressions. Other implementations may perform the steps in a different order, omit certain steps, and/or perform different and/or additional steps than those illustrated in FIG. 3. For convenience, aspects of FIG. 3 will be described with reference to one or more components of FIG. 1 that may perform the method, such as a bidder process 114 configured with selected aspects of the present disclosure.

At block 302, the bidder process 114 may await solicitation, e.g., from a distributed auction process 112, to bid on an impression associated with an IP address. At block 304, the bidder process 114 may receive solicitation, e.g., from a distributed auction process 112, to bid on a particular impression associated with a particular IP address. As described above, the IP address (or other network identifier) may be used by an end user device 120 that operates an application with an online interface such as a webpage or a streaming audio/video interface. Such online interfaces may include impressions in various forms, such as regions of webpages, pop-up windows, time intervals between songs or videos, and so forth.

At block 306, the bidder process 114 may retrieve or otherwise obtain bidding guidelines associated with the IP address for which the impression is solicited. As described above with reference to FIG. 2, in various embodiments, bidder process 114 may obtain/retrieve bidding guidelines from memory-mapped region 262 of volatile memory 260 that is local to bidder server 115. For example, at block 306A, the bidder process 114 may look up in its own index 264 an IP address, and then map that IP address to an appropriate memory location of a memory-mapped region (e.g., 262) of volatile memory 260.

At block 308, bidder process 114 may determine, based at least in part on the bidding guidelines received/obtained at block 306, a bid to make to populate the impression associated with the IP address with consumable campaign content. Bidder process 114 may have various levels of discretion to determine a bid amount from the bidding guidelines it receives/obtains at block 306. In some embodiments, the data may include historical data and/or statistics. Bidder process 114 may use this data, alone or in combination with other data points, to calculate a bid to submit. For example, suppose the IP address associated with the impression is associated with historical data that evidences an interest in outdoor activities. Suppose further that bidder process 114 has an inventory of campaign content that includes one promotion content item related to camping and another promotion content item related to furniture. Bidder process 114 may determine from data obtained at block 306 that it would submit a much higher bid to populate the impression with the camping promotional content item than it would the furniture promotional content item. Accordingly, bidder process 114 make submit the bid to populate the impression with the camping promotional content item.

But in other embodiments, and as mentioned above, the bidding guidelines may include pre-calculated data, or even pre-calculated bids. Using the example above, in some embodiments, one bid to populate the impression associated with the IP address with the camping promotion content item and another bid to populate the impression with the furniture promotional content may be pre-calculated, e.g., by bidding management system 102. These pre-calculated bids may be made available to bidder process 104, e.g., by way of creative bus 134 and/or IP creative bus 136 (via memory-mapped region 262). Of course, bidder process 114 is not required to bid on every impression solicited to it. If nothing in inventory of bidding process 114 is particularly well-suited to populate a given impression (e.g., a minimum bid threshold is not satisfied, or there are no matching pre-calculated bids), then bidder process 114 may skip bidding on a particular impression. In yet other embodiments, and as will be explained below with reference to FIGS. 5A and 5B, bidder process 114 may calculate a bid in accordance with a pre-calculated demand slope.

At block 310, bidder process 114 may submit the bid determined at block 308 to a distributed auction process 112 or other similar node. At block 312, bidder process 114 or another component may trigger an update of one or more databases, such as campaign database 122 and/or statistics database 124, to reflect that the bid was submitted and/or to reflect an outcome of the bid. For example, as was depicted in FIG. 1, bidder process 114 may update one or more event logs 150, which may in turn cause update triggers 152 to initiate update engine 154 to update and/or add new records to databases 122 and/or 124. At block 314, one or more components, such as committer engine 108, may append, e.g., to memory mapped region 262 of non-volatile memory 260, one or more records indicative of the outcome of bid, which could include a newly-calculated bid.

Figure 4:
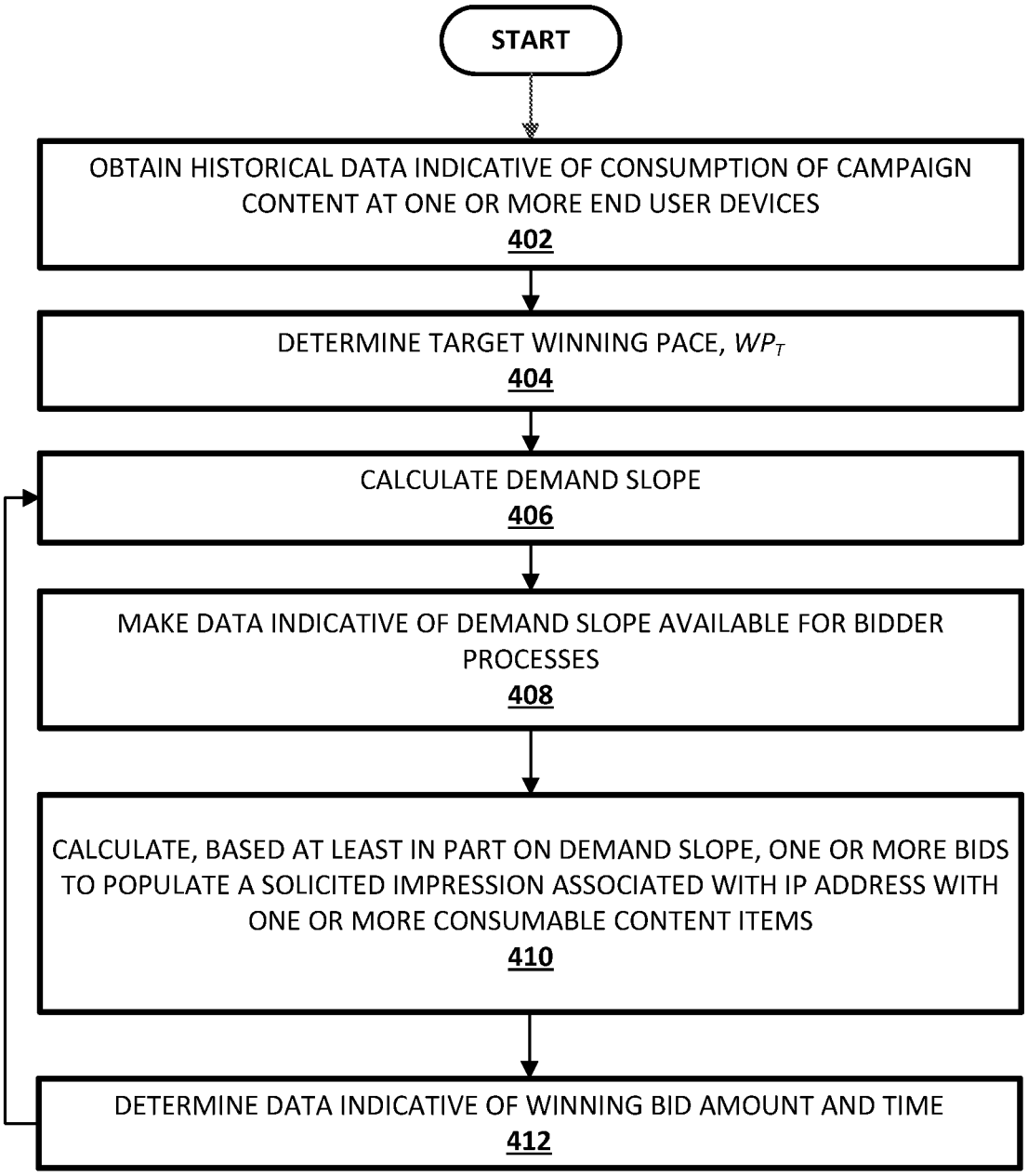
FIG. 4 is a flow chart of an example method for calculating and/or pre-calculating one or more bids to populate an impression with consumable campaign content using demand slopes, in accordance with various embodiments.

Various techniques and/or calculations may be used by various components, such as bidding management system 102 and/or bidder process 104, to calculate an appropriate bid to submit for a particular impression associated with a particular IP address (e.g., at blocks 308-310 of FIG. 3). One such technique 400 is depicted in FIG. 4. Various operations may be added, omitted, or reordered. The operations in FIG. 4 may be performed at various times and by various components depicted in FIGS. 1 and 2. For example, they may be performed periodically, e.g., in anticipation of receiving solicitations for bids to populate impressions with campaign content. Additionally or alternatively, the operations in FIG. 4 may be performed "on the fly," such as in response to receipt of a solicitation to populate an impression associated with a particular IP address, or in response to a successful/unsuccessful bid. As described above, performing operations of FIG. 4 ahead of time may mean less computation will be required from bidder processes 114 to bid on impressions in real time. Less computation means quicker bids, which gives bidder processes 114 a competitive advantage.

At block 402, one or more components of bidding management system 102 may obtain, e.g., from databases 122 and/or 124, historical and/or statistical data indicative of prior auction activity and/or consumption of campaign content by devices using one or more particular IP addresses. For example, and as noted above, an entity initiating a campaign may provide a list of IP addresses that it wishes to target, and the list may be stored in databases 122/124. The list may include IP addresses within a particular geographic region, or IP addresses known to be associated with particular interests or demographics. In some instances, the campaigning entity may, at the start of the campaign, provide historical/statistical data indicative of consumption of campaign content at end user devices associated with the list of IP addresses. In other instances, statistical information determined empirically from prior campaigns (e.g., associated with the same campaigning entity, associated with IP addresses demographically similar to those provided by a campaigning entity, associated with the same IP addresses, etc.) may be obtained.

At block 404, one or more components of bidding management system 102 may determine a so-called "target winning pace," or $WP_T$. In some embodiments, the target winning pace may be determined initially based at least in part on an expected winning pace. An "expected winning pace" may in some embodiments be an even split of a remaining number of desired wins of a campaign across a remaining temporal duration of the campaign. As a non-limiting example, if a campaign has a duration of ten hours and a goal to win one hundred bids, then the expected winning pace may be ten wins per hour. In some embodiments, the target winning pace may be set to the expected winning pace at the outset of the campaign.

At block 406, one or more components of bidding management system 102 may calculate (e.g., predict) a so-called "demand slope." In various embodiments, the demand slope may represent, as a function of time, a target bid amount to populate an actual or hypothetical solicited impression associated with one or more IP addresses with one or more particular consumable content items. On a more abstract level, a demand slope may represent demand increasing in a way that corresponds roughly (or precisely in some embodiments) with a cumulative distribution of historical winning bids. Thus, the demand slope generally may increase over time, such that the more time passes, the higher the target bid will be. An example of demand slope is discussed below with regard to FIGS. 5A-B.

At block 408, one or more components of bidding management system 102 may make data indicative of the demand slope available to one or more bidder processes. For example, and as described above, bidder processes 114 may receive the data via one or more buses 134 and/or 136. The data may be made available to bidder processes 114 in various ways. For example, in some embodiments, committer engine 108 may append records to memory-mapped region 262. Bidder processes 114 configured with selected aspects of the present disclosure may re-index their local indexes 264 in order to map IP addresses to these newly-appended records.

At block 410, a bidder process 114 and/or one or more components of bidding management system 102 may calculate one or more bids to populate the solicited impression with one or more consumable content items. This may be done at various times, such as in response to solicitation of a bidder process to bid on an impression at block 304 of FIG. 3. This calculation may be based at least in part on the data indicative of the demand slope made available at block 408. For example, depending on time elapsed since the start of an auction, a bidder process 114 may map the elapsed time to a corresponding bid amount located on the demand slope, and then submit that bid to distributed auction process 112.

At block 412, a bidder process 114 and/or one or more components of bidding management system 102 may determine data indicative of a winning bid amount and the time at which the bid won. This data may then be used to recalculate the demand slope at block 406. Generally speaking, if the bid amount and/or time is behind demand pace, the demand slope may be recalculated to be steeper, so that bidder processes 114 may make higher bids and/or bid more quickly in order to "catch up" with demand. If the bid amount and/or time is ahead of demand pace, the bidder processes may be paying too much for impressions. The demand slop may be recalculated to be less steep, so that bidder processes 114 may make lower bids and/or bid more slowly in order to save money.

Figure 5A:
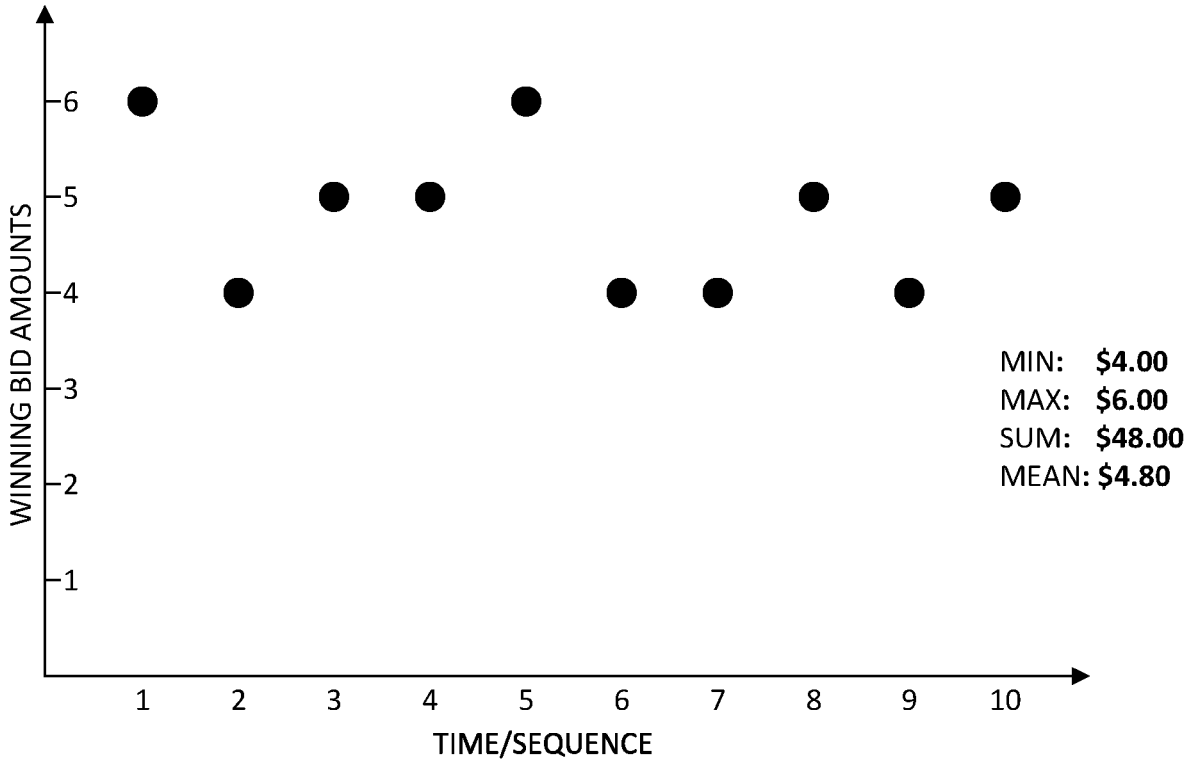
FIGS. 5A and 5B demonstrate visually how example demand slopes may be calculated and recalculated, in accordance with various embodiments.
Figure 5B:
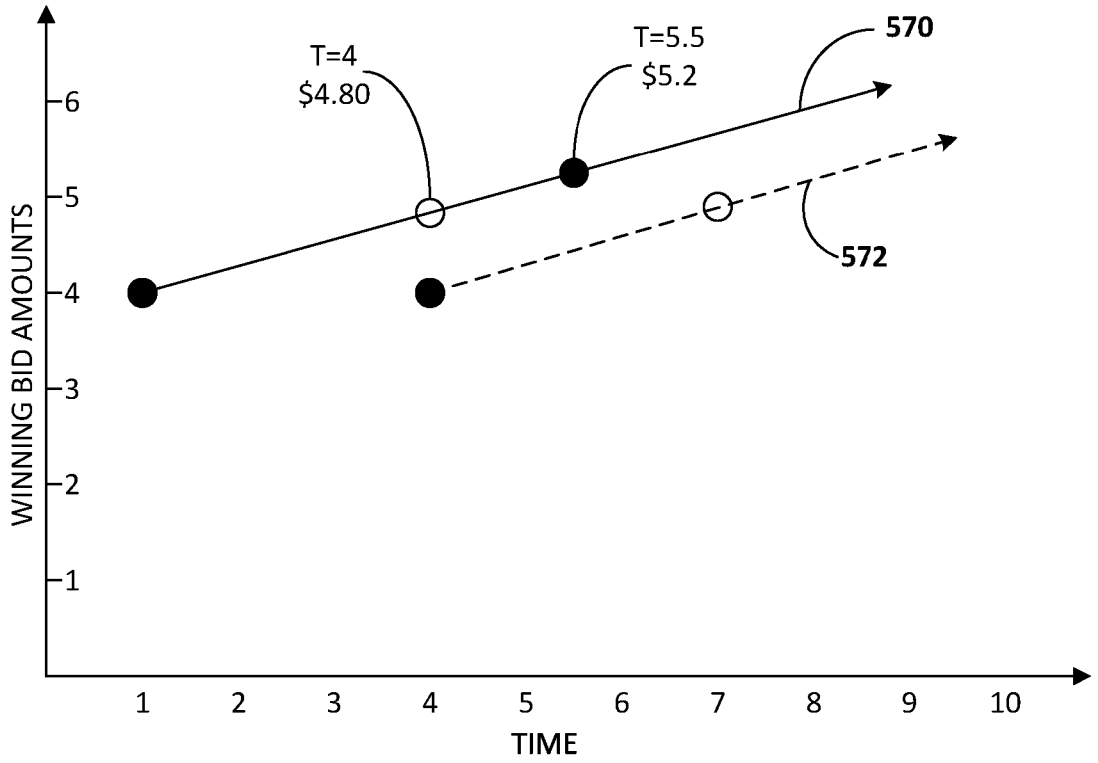

FIGS. 5A and 5B are graphs that visually demonstrate how demand slopes may be calculated and recalculated, in accordance with various embodiments. FIG. 5A graphically depicts an auction history associated with, for instance, a particular targeted IP address or group of IP addresses, a particular creative, all creatives for a particular bidding entity, all creatives across a class of bidding entities, and so forth. The Y axis represents winning bid amounts and the X axis represents a sequence in which those bid amounts were won. The winning bid amounts are shown in a particular sequence for illustrative purposes only. In various embodiments, only statistics related to those winning bid amounts, such as the minimum winning bid amount and/or the mean winning bid amount, are used in disclosed techniques, and the sequence and/or time in which winning bids were made is irrelevant.

In FIG. 5A, it can be seen that there were ten successful winning bids. The minimum winning bid was $4.00, the maximum was $6.00, the sum of all bids was $48.00, and the mean winning bid amount ($48.00/10) was $4.80. In various embodiments, this data may be used to project a demand slope that may be used to select bid amounts for subsequent impressions. FIG. 5B depicts one example of how this might work. Of course, real life historical data may potentially include more (or less) than ten successful bids, and the bid amounts may not necessarily be limited to one dollar increments as is depicted in FIG. 5A (this is done in this example for simplicity's sake only).

In FIG. 5B, the Y axis represents bid amounts. Unlike the graph of FIG. 5A, in which the X axis only loosely represented time and/or a sequence of winning bids, in FIG. 5B, the X axis represents actual time because online content auctions typically occur in real time, and impressions may become available for bidding at a non-regimented pace, e.g., in spurts and/or at random time intervals. In this example, the minimum historical bid of $4.00 is used at time T=1 as a starting point for an initial demand slope 570. Initial demand slope 570 may represent and amount that a particular bidder process (e.g., 114 in FIG. 1) will bid at any given moment in time. It can be seen that as time passes without a winning bid, the amount the bidder process will bid increases.

Suppose the bidder process is expected to win at a pace of approximately every three seconds. That would mean the bidder process is expected to win at T=4 for approximately $4.80 (as indicated by the white dot), which was the mean winning bid amount calculated from the winning bids depicted in FIG. 5A. However, the bidder process doesn't actually win a bid until T=5.5 for an amount of $5.20. This indicates that the bidder process is bidding slightly behind pace of demand. Accordingly, the demand slope may be increased.

In some embodiments, a bidder process (or another component on the bidder process' behalf) may calculate a new demand slope in response to a determination that bidding is ahead of or behind demand pace. For example, in FIG. 5B, bidding is behind pace of demand, and so a new demand slope 572 has been calculated. The new demand slope 572 begins at the last expected win time of 4 and, in keeping with the expected win pace of three seconds, is calculated to win at T=7 for $4.87 ((48+5.2)/(10+1)=$4.87). This results in new demand slope 572 being slightly steeper than previous demand slope 570, which is an attempt to "catch up" the bidding pace with the increased demand.

The demand slopes depicted in FIGS. 5A and 5B are linear, but this is not meant to be limiting. In other embodiments, more complex curves may be employed to determine bid amounts at various points in time. In some embodiments, a demand slope may have a curve shape that compensates for historical observed winning bid distributions. Additionally or alternatively, in some embodiments, rather than basing a demand slope on all historical data, a sliding window may be employed to keep enough samples to quickly sort and obtain, for instance, quartiles of recent history. This recent history may be translated into a variance, which in turn may be used to compute a cumulative curve, rather than a straight line.

FIG. 6 is a block diagram of an example computer system 610. Computer system 610 typically includes at least one processor 614 which communicates with a number of peripheral devices via bus subsystem 612. These peripheral devices may include a storage subsystem 624 including, for example, a memory subsystem 626 and a file storage subsystem 626, user interface input devices 622, user interface output devices 620, and a network interface subsystem 616. The input and output devices allow user interaction with computer system 610. Network interface subsystem 616 provides an interface to outside networks and is coupled to corresponding interface devices in other computer systems.

User interface input devices 622 may include a keyboard, pointing devices such as a mouse, trackball, touchpad, a wearable visual display unit ,a graphics tablet, a scanner, a touchscreen incorporated into the display, audio input devices such as voice recognition systems, microphones, and/or other types of input devices. In general, use of the term "input device" is intended to include all possible types of devices and ways to input information into computer system 610 or onto a communication network.

User interface output devices 620 may include a display subsystem, a printer, a fax machine, or non-visual displays such as audio output devices. The display subsystem may include a cathode ray tube (CRT), a flat-panel device such as a liquid crystal display (LCD), a projection device, a wearable device such as a smart watch or smart glasses, or some other mechanism for creating a visible image. The display subsystem may also provide non-visual display such as via audio output devices. In general, use of the term "output device" is intended to include all possible types of devices and ways to output information from computer system 610 to the user or to another machine or computer system.

Storage subsystem 624 stores programming and data constructs that provide the functionality of some or all of the modules described herein. For example, the storage subsystem 624 may include the logic to perform one or more of the methods described herein such as, for example, the methods and techniques demonstrated by FIGS. 3-5.

These software modules are generally executed by processor 614 alone or in combination with other processors. Memory 626 used in the storage subsystem can include a number of memories including a main random access memory (RAM) 630 for storage of instructions and data during program execution and a read only memory (ROM) 632 in which fixed instructions are stored. A file storage subsystem 626 can provide persistent storage for program and data files, and may include a hard disk drive, a floppy disk drive along with associated removable media, a CD-ROM drive, an optical drive, or removable media cartridges. The modules implementing the functionality of certain implementations may be stored by file storage subsystem 626 in the storage subsystem 624 or in other machines accessible by the processor(s) 614.

Bus subsystem 612 provides a mechanism for letting the various components and subsystems of computer system 610 communicate with each other as intended. Although bus subsystem 612 is shown schematically as a single bus, alternative implementations of the bus subsystem may use multiple busses.

Computer system 610 can be of varying types including a workstation, server, computing cluster, blade server, server farm, or any other data processing system or computing device. Due to the ever-changing nature of computers and networks, the description of computer system 610 depicted in FIG. 6 is intended only as a specific example for purposes of illustrating some implementations. Many other configurations of computer system 610 are possible having more or fewer components than the computer system depicted in FIG. 6.

A number of technical advantages in addition to those already described may be realized using techniques disclosed herein. For example, calculating bids based on IP addresses associated with impressions, as opposed to, say, cookies, may enable use of historical and/or statistical data associated with IP addresses. Thus, if a particular entity wishes to initiate a campaign targeted towards a group of IP address with known histories and/or statistics, it may be possible to more accurately project future activity associated with those IP addresses, facilitating more accurate campaign cost estimation ahead of time. Another technical advantage is that by facilitating relatively quick bidding (e.g., due to the availability of pre-calculated data such as pre-calculated bids), it is less likely that a bidder process 114 will timeout before the end of an auction. Having lower timeout frequency may enable a campaign to have greater reach. Yet another technical advantage of employing techniques described herein is that it is easier to predict traffic flow associated with IP addresses than it is to predict traffic flow associated with cookies, since cookies may have little to no history. Thus, techniques described herein may facilitate improved pace of spending on impressions to satisfy various campaign constraints, particularly over pace of spending on impressions associated with cookies.

While several implementations have been described and illustrated herein, a variety of other means and/or structures for performing the function and/or obtaining the results and/or one or more of the advantages described herein may be utilized, and each of such variations and/or modifications is deemed to be within the scope of the implementations described herein. More generally, all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific implementations described herein. It is, therefore, to be understood that the foregoing implementations are presented by way of example only and that, within the scope of the appended claims and equivalents thereto, implementations may be practiced otherwise than as specifically described and claimed. Implementations of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The invention claimed is:

1. A bidding management system comprising one or more processors and memory storing instructions that, in response to execution of the instructions by the one or more processors, cause the one or more processors to:

obtain historical and statistical data associated with one or more IP addresses, the historical and statistical data indicative of consumption of consumable content at one or more end user devices associated with the one or more IP addresses;

calculate, based at least in part on the obtained data and a target winning pace for winning a plurality of bids over a temporal duration of a campaign, a demand slope that represents, as a function of time, target bid amounts to populate an actual or hypothetical solicited impression associated with the one or more IP addresses with one or more particular consumable content items, wherein the target bid amounts represented by the demand slope increase over time to satisfy the target winning pace;

cause the one or more processors to append data indicative of the demand slope to a memory-mapped region of volatile memory, wherein the data indicative of the demand slope is mapped to the one or more IP addresses in the memory-mapped region;

receive, from a content auction computing system, a digital solicitation to bid on an impression associated with a particular IP address;

map the particular IP address to the data indicative of the demand slope;

determine a point in time within the temporal duration of the campaign;

map the point in time within the temporal duration of the campaign to the demand slope to determine a target bid amount for the impression associated with the IP address; and submit, to the content auction computing system, the target bid amount for the impression associated with the IP address.

2. The bidding management system of claim 1, wherein the memory stores instructions to cause the one or more processors to calculate the demand slope based at least in part on a comparison of the target winning bidding pace to an actual winning pace.

3. The bidding management system of claim 2, wherein the memory stores instructions to cause the one or more processors to decrease a demand slope in response to a determination that the actual winning pace exceeds the target winning pace.

4. The bidding management system of claim 2, wherein the memory stores instructions to cause the one or more processors to increase a demand slope in response to a determination that the actual winning pace lags behind the target winning pace.

5. The bidding management system of claim 3, wherein the memory stores instructions to cause the one or more processors to recalculate the demand slope based at least in part on data indicative of a winning bid amount and time.

6. A bidding management method implemented using one or more processors and comprising:

obtaining historical and statistical data associated with one or more IP addresses, the historical and statistical data indicative of consumption of consumable content at one or more end user devices associated with the one or more IP addresses;

calculating, based at least in part on the obtained data and a target winning pace for winning a plurality of bids over a temporal duration of a campaign, a demand slope that represents, as a function of time, target bid amounts to populate an actual or hypothetical solicited impression associated with the one or more IP addresses with one or more particular consumable content items, wherein the target bid amounts represented by the demand slope increase over time to satisfy the target winning pace;

causing the one or more processors to append data indicative of the demand slope to a memory-mapped region of volatile memory, wherein the data indicative of the demand slope is mapped to the one or more IP addresses in the memory-mapped region;

receiving, from a content auction computing system, a digital solicitation to bid on an impression associated with a particular IP address;

mapping the particular IP address to the data indicative of the demand slope;

determining a point in time within the temporal duration of the campaign;

mapping the point in time within the temporal duration of the campaign to the demand slope to determine a target bid amount for the impression associated with the IP address; and submitting, to the content auction computing system, the target bid amount for the impression associated with the IP address.

7. The bidding management method of claim 6, further comprising calculating the demand slope based at least in part on a comparison of the target winning bidding pace to an actual winning pace.

8. The bidding management method of claim 7, further comprising decreasing a demand slope in response to a determination that the actual winning pace exceeds the target winning pace.

9. The bidding management method of claim 7, further comprising increasing a demand slope in response to a determination that the actual winning pace lags behind the target winning pace.

10. The bidding management method of claim 8, further comprising recalculating the demand slope based at least in part on data indicative of a winning bid amount and time.

11. A non-transitory computer-readable medium for implementing a bidding management method, the medium comprising instructions that cause one or more processors to:

obtain historical and statistical data associated with one or more IP addresses, the historical and statistical data indicative of consumption of consumable content at one or more end user devices associated with the one or more IP addresses;

calculate, based at least in part on the obtained data and a target winning pace for winning a plurality of bids over a temporal duration of a campaign, a demand slope that represents, as a function of time, target bid amounts to populate an actual or hypothetical solicited impression associated with the one or more IP addresses with one or more particular consumable content items, wherein the target bid amounts represented by the demand slope increase over time to satisfy the target winning pace;

cause the one or more processors to append data indicative of the demand slope to a memory-mapped region of volatile memory, wherein the data indicative of the demand slope is mapped to the one or more IP addresses in the memory-mapped region;

receive, from a content auction computing system, a digital solicitation to bid on an impression associated with a particular IP address;

map the particular IP address to the data indicative of the demand slope;

determine a point in time within the temporal duration of the campaign;

map the point in time within the temporal duration of the campaign to the demand slope to determine a target bid amount for the impression associated with the IP address; and submit, to the content auction computing system, the target bid amount for the impression associated with the IP address.

12. The non-transitory computer-readable medium of claim 11, further comprising instructions to calculate the demand slope based at least in part on a comparison of the target winning bidding pace to an actual winning pace.

13. The non-transitory computer-readable medium of claim 12, further comprising instructions to decrease a demand slope in response to a determination that the actual winning pace exceeds the target winning pace.

14. The non-transitory computer-readable medium of claim 12, further comprising instructions to increase a demand slope in response to a determination that the actual winning pace lags behind the target winning pace.

15. The non-transitory computer-readable medium of claim 13, further comprising instructions to recalculate the demand slope based at least in part on data indicative of a winning bid amount and time.

* * * * *